US012263513B2

(12) United States Patent
Shouji

(10) Patent No.: US 12,263,513 B2
(45) Date of Patent: Apr. 1, 2025

(54) COATED DIE FOR USE IN HOT STAMPING

(71) Applicant: Proterial, Ltd., Tokyo (JP)

(72) Inventor: Tatsuya Shouji, Tokyo (JP)

(73) Assignee: Proterial, Ltd., Tokyo (JP)

( * ) Notice: Subject to any disclaimer, the term of this patent is extended or adjusted under 35 U.S.C. 154(b) by 880 days.

(21) Appl. No.: 17/298,955

(22) PCT Filed: Nov. 27, 2019

(86) PCT No.: PCT/JP2019/046461

§ 371 (c)(1),
(2) Date: Jun. 2, 2021

(87) PCT Pub. No.: WO2020/116291

PCT Pub. Date: Jun. 11, 2020

(65) Prior Publication Data

US 2022/0032357 A1 Feb. 3, 2022

(30) Foreign Application Priority Data

Dec. 3, 2018 (JP) ..... 2018-226540

(51) Int. Cl.

| | |
|---|---|
| ***B21D 37/01*** | (2006.01) |
| ***B21D 22/02*** | (2006.01) |
| ***C23C 28/00*** | (2006.01) |

(52) U.S. Cl.

CPC ..... *B21D 22/02* (2013.01); *B21D 22/022* (2013.01); *B21D 37/01* (2013.01); *C23C 28/34* (2013.01); *C23C 28/42* (2013.01); *C23C 28/44* (2013.01)

(58) Field of Classification Search

CPC ..... B21D 22/022; B21D 22/02; B21J 13/02
See application file for complete search history.

(56) References Cited

U.S. PATENT DOCUMENTS

2014/0287214 A1 9/2014 Cha
2018/0141102 A1* 5/2018 Honda ..... C23C 14/028

FOREIGN PATENT DOCUMENTS

CN 1661132 8/2005
CN 102127733 7/2011

(Continued)

OTHER PUBLICATIONS

"Office Action of China Counterpart Application", issued on Oct. 10, 2022, with English translation thereof, p. 1-p. 13.

(Continued)

*Primary Examiner* — Jennifer S Matthews
(74) *Attorney, Agent, or Firm* — JCIPRNET

(57) ABSTRACT

A coated die for use in hot stamping has a hard film having an alternating lamination section formed by alternating lamination of a1 layers consisting of nitride having 30% or more of chromium in atomic ratio in a metal part, and a2 layers consisting of nitride having 50% or more of vanadium in atomic ratio in a metal part. When $t_{a1}$ and $t_{a2}$ are defined as thicknesses of the a1 layer and the a2 layer respectively, a film thickness ratio Xb is defined as a film thickness ratio $t_{a2}/t_{a1}$ of a1 layers and a2 layers adjacent to each other in a substrate-side region of the alternating lamination section and a film thickness ratio Xt is defined as a film thickness ratio $t_{a2}/t_{a1}$ of a1 layers and a2 layers adjacent to each other in an outermost surface side region of the alternating lamination section, it holds that Xt>Xb.

2 Claims, 4 Drawing Sheets

(56) References Cited

FOREIGN PATENT DOCUMENTS

| | | |
|---|---|---|
| CN | 102166849 | 8/2011 |
| CN | 102528104 | 7/2012 |
| CN | 105593581 | 5/2016 |
| CN | 107075692 | 8/2017 |
| CN | 108138306 | 6/2018 |
| JP | 2006051510 | 2/2006 |
| JP | 2008207219 | 9/2008 |
| JP | 2011183545 | 9/2011 |
| WO | 2013047548 | 4/2013 |

OTHER PUBLICATIONS

"International Search Report (Form PCT/ISA/210) of PCT/JP2019/046461," mailed on Feb. 25, 2020, with English translation thereof, pp. 1-4.

"Office Action of Korea Counterpart Application" with English translation thereof, issued on Mar. 15, 2022, p. 1-p. 5.

* cited by examiner

COATED DIE FOR USE IN HOT STAMPING

CROSS-REFERENCE TO RELATED APPLICATION

This application is a 371 application of an international PCT application serial no. PCT/JP2019/046461, filed on Nov. 27, 2019, which claims the priority benefit of Japan application JP2018-226540, filed on Dec. 3, 2018. The entirety of the above-mentioned patent application is hereby incorporated by reference herein and made a part of this specification.

BACKGROUND

Technical Field

The present invention relates to a coated die coated with a hard film and applied to a die for hot stamping.

Related Art

Conventionally, in plastic processing such as forging and press processing, dies are used in which steel typified by tool steel such as cold die steel, hot die steel, and high-speed steel, super hard alloys, or the like are used as a base material. In the plastic processing using a die for press processing or forging, due to the sliding of the work surface of the die and a material to be processed, wear such as abrasion, galling, or the like is likely to occur on the work surface of the die, and the life of the die is desired to be improved. Particularly, bending molds and drawing molds are subjected to a high molding pressure, and due to the sliding of the material to be processed and the die, galling is likely to occur. Galling as used herein refers to a phenomenon in which a chemically active surface is formed on the work surface of either or both of the members that slide on each other, and the chemically active surface is strongly adhered to and fixed to the mating side or the chemically active surface causes constituents of either surface to be torn off and transferred to the surface of the mating side. Therefore, dies used for bending molds and drawing molds are required to have a particularly high level of strength and galling resistance.

As a method of improving the galling resistance of the die, it is effective to form a hard film consisting of nitride or carbide by a surface treatment. In the surface treatment, a thermo-reactive deposition/diffusion method (hereinafter, referred to as TRD method), a chemical vapor deposition method (hereinafter, referred to as CVD method), a physical vapor deposition method (hereinafter, referred to as PVD method), and the like are used. After a treatment at a temperature close to a quenching temperature of a die taking steel as a base material is performed, tempering (a part of the die is re-quenched therebefore) is performed and the TRD method or the CVD method is used. However, there is a case that deformation or a dimension change of the die due to the high temperature treatment becomes a problem. In addition, although these treatments are repeatedly performed, the TRD method and the CVD method form a film by using carbon in the steel material of the die base material, and thus if the treatments are repeatedly performed, the carbon near the surface of the die is reduced, which may lead to a decrease of hardness or a decrease of adhesion to the film. On the other hand, in the PVD method, the coating temperature is lower than the tempering temperature of steel in various coating forming mechanisms, and thus softening of the die caused by coating is reduced, and the deformation or the dimension change of the die is less likely to occur. As PVD films which improve the abrasion resistance of the die, Ti-based films such as TiN, TiCN, and TiAlN, Cr-based films such as CrN, CrAlN, and AlCrN, V-based films such as VCN and VC, and the like are conventionally implemented.

Conventionally, various studies are made on the coated die to which the above-described film is applied. For example, in Patent literature 1, for the purpose of improving sliding characteristics such as the abrasion resistance and the galling resistance in a sliding environment with a material to be processed, the applicant proposes a coating tool coated with a hard film in which AlCrSi nitride and V nitride are alternately laminated. In addition, in Patent literature 2, for the purpose of improving the abrasion resistance and the galling resistance of the die, the applicant proposes a coated member which has an excellent sliding characteristic, wherein the coated member includes an A layer formed by alternating lamination of a1 layers consisting of nitride or carbonitride in which the metal part of the film has 30% or more of chromium in atomic ratio, and a2 layers consisting of nitride or carbonitride in which the metal part has 60% or more of vanadium in atomic ratio, and a B layer which is an upper layer of the A layer and consists of nitride or carbonitride in which the metal part has 60% or more of vanadium in atomic ratio.

LITERATURE OF RELATED ART

Patent Literature

Patent literature 1: Japanese Patent Laid-Open No. 2011-183545

Patent literature 2: International Publication No. 2013/047548

SUMMARY

Problems to be Solved

In recent years, there has been a strong demand for the compatibility of environmental performance and collision safety performance for automobiles, and as a steel plate used in a vehicle body, the application of an ultra-high-strength steel plate (hereinafter, also described as an ultra-high-tensile material) having a tensile strength of over 1 GPa is increased. Because the ultra-high-tensile material has high strength, the press molding surface pressure is likely to increase locally, and because the load on the die is increased, there is a case that a sufficient life may not be obtained even if the above-mentioned surface treatment is executed. In addition, because the ultra-high-tensile material has a large springback, it tends to be difficult to maintain the shape at the time of press molding. Therefore, there is an upper limit for the tensile strength at which cold-molding can be performed by pressing. Thus, regarding molding of this ultra-high-tensile material, it is effective to apply the hot stamping method in which a material to be processed is heated and press molding and quenching are performed at the same time. However, when the material to be processed has a high strength, or when the hard film formed on the work surface of the die (the surface where the die and the material to be processed come into contact and slide) has low slidability, galling may occur due to local adhesion of the material to be processed, and a significant reduction of the life of the die may be caused. In addition, as the hot stamping processing progresses, the temperature of the die is also increased, and an environment is made where oxidation of the surface of the material to be processed is likely to be promoted and the abrasion is likely to progress due to the sliding with generated oxide, and thus it is necessary to further improve the abrasion resistance. The inventions described in Patent literatures 1 and 2 are excellent inventions capable of suppressing sudden galling that occurs in an initial stage by increasing the adhesion resistance of the film, but the abrasion resistance when the processing progresses and the die becomes hot is not described, and there is room for further study. Particularly, although a V-containing film can suppress the adhesion of the material to be processed, it is also conceivable that the abrasion resistance may deteriorate because the oxidation of the film progresses too much in the processing at a high temperature when the proportion of V is large.

In view of the above-described problems, the purpose of the present invention is to provide a coated die which is excellent in both the galling resistance and the abrasion resistance when used in hot stamping.

Means to Solve Problems

The inventor analysed the wear form of the coated die in a hot stamping processing environment. As a result, it is found that the die tends to have a long life by emphasizing the galling resistance of the hard film formed on the work surface of the die and the material to be processed in a state that the die temperature is low in an initial stage of the processing, and emphasizing the abrasion resistance against the generated oxide caused by the material to be processed in a state that the die temperature is stable in an intermediate stage of the processing. Besides, it is found that there is a film configuration capable of improving characteristics of both the galling resistance and the abrasion resistance, and the present invention is thought out.

That is, the present invention is a coated die for use in hot stamping which has a hard film on a work surface, wherein the hard film has an alternating lamination section formed by alternating lamination of a1 layers consisting of nitride in which a metal part including semimetals has 30% or more of chromium in atomic ratio, and a2 layers consisting of nitride in which a metal part including semimetals has 50% or more of vanadium in atomic ratio.

When $t_{a1}$ and $t_{a2}$ are defined as thicknesses of the a1 layer and the a2 layer respectively, a film thickness ratio Xb is defined as a film thickness ratio $t_{a2}/t_{a1}$ of a1 layers and a2 layers adjacent to each other in a substrate-side region of the alternating lamination section and a film thickness ratio Xt is defined as a film thickness ratio $t_{a2}/t_{a1}$ of a1 layers and a2 layers adjacent to each other in an outermost surface side region of the alternating lamination section, it holds that Xt>Xb.

Preferably, the Xt is 1.2 or more, and the Xb is less than 1.2.

Preferably, a total film thickness of the hard film is 6 μm or more.

Effect

According to the present invention, a coated die which is excellent in both galling resistance and abrasion resistance when used in hot stamping can be provided.

DESCRIPTION OF THE EMBODIMENTS

Figure 1:
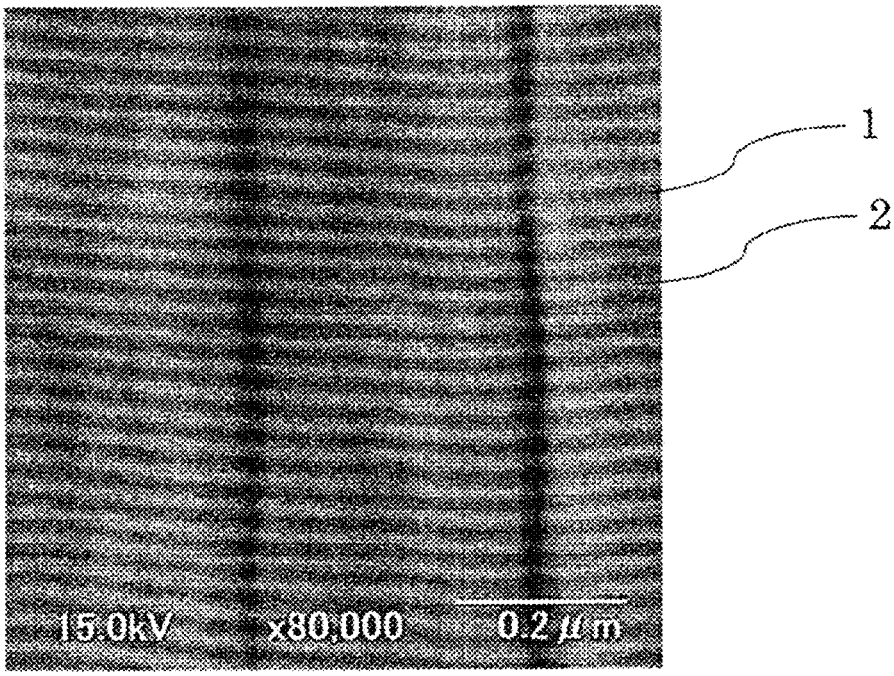
FIG. 1 is a cross-sectional photograph of Sample No. 1 showing an example of an alternating lamination section on a substrate side of the present invention.

An embodiment of the present invention is described below in detail. Moreover, the present invention is not limited to the embodiment.

A coated die of the embodiment has a hard film on a work surface. The hard film has an alternating lamination section formed by alternating lamination of a1 layers consisting of nitride in which the metal part including semimetals has 30% or more of chromium in atomic ratio, and a2 layers consisting of nitride in which the metal part including semimetals has 50% or more of vanadium in atomic ratio. Hereinafter, the atomic ratio of the chromium and the vanadium is the atomic ratio in the metal part including semimetals.

The a1 layer in the embodiment consists of nitride in which chromium is 30% or more in atomic ratio (hereinafter, also described as a CrN-based film). The CrN-based film has excellent heat resistance and abrasion resistance, and contributes to improving the life of the die in a high-load environment. As long as the chromium is 30% or more, the CrN-based film may include at least one of transition metals of Groups 4, 5, and 6 other than chromium within a range not interfering with the effect of the a1 layer. Evidently, the chromium may be 100%. For example, the CrN-based film is preferable because the abrasion resistance in a temperature region in a die for use in hot stamping can be improved by selecting the CrN-based film from CrN, CrTiN, CrVN, CrSiN, CrBN, CrSiBN, CrTiSiN, CrVSiN, AlCrN, AlTiCrN, AlVCrN, AlCrSiN, AlTiCrSiN, and AlVCrSiN. Moreover, when the vanadium is contained in the a1 layer, the content is preferably less than 50%. More preferably, AlCrSiN is applied. When the content of the chromium is lower than 30%, it tends to be less likely to obtain the above-described effect of improving the heat resistance and the abrasion resistance. The upper limit of the chromium content is not particularly limited, and can be appropriately changed according to the type and the application of the film. For example, when AlCrSiN is applied, the content of the chromium may be set to 80% or less in atomic ratio in order to easily obtain the effect of improving the heat resistance and the abrasion resistance. When AlCrSiN is applied, by controlling in a manner that $20 \leq x < 70$, $30 \leq y < 75$, and $0 < z < 10$ in a composition formula of AlxCrySiz, the fragile hexagonal crystal structure is suppressed from becoming the main body and the cubic crystal structure becomes the main body, the abrasion resistance and the heat resistance can be stably improved, and thus it is preferable. The above-described crystal structure can be confirmed by, for example, the X-ray diffraction method, and when the peak of the cubic crystal structure has the maximum intensity, the cubic crystal structure can be regarded as the main body even when other crystal structures are included.

The a2 layer in the embodiment consists of nitride in which vanadium is 50% or more in atomic ratio (hereinafter, also described as VN-based film). In an environment of an initial stage of hot stamping processing, the VN-based film is appropriately oxidized to form an oxide layer and form double oxide having a low melting point and containing components of a material to be processed. Therefore, adhesion from the material to be processed can be prevented, and local galling and adhesion abrasion in the initial stage of the processing can be suppressed. When the vanadium is less than 50%, the effect of suppressing the galling and the adhesion abrasion may not be sufficiently exhibited. Moreover, at least one of transition metals of Groups 4, 5, and 6 other than vanadium may be included within a range not interfering with the effect of the present invention. It is preferably the nitride in which the metal part has 60% or more of vanadium in atomic ratio, and more preferably, the vanadium is 70% or more. Evidently, the vanadium may be 100%.

Figure 6:
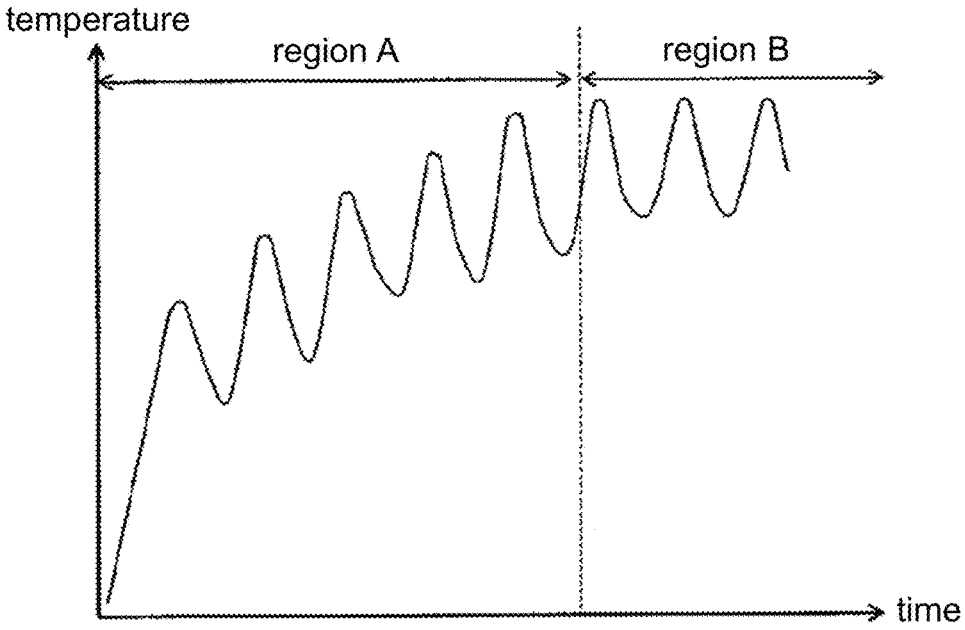
FIG. 6 is a graph showing an example of a temperature change of a die for use in hot stamping.

A hard film of the embodiment has a structure formed by alternating lamination of the above-described a1 layers and a2 layers. By having this structure, the abrasion resistance and the heat resistance that the CrN-based film has and the galling resistance and the adhesion resistance that the VN-based film has can be effectively exhibited without interfering with each other. Furthermore, in the embodiment, when a film thickness ratio X (a2/a1) is defined as a film thickness ratio of the a1 layer and the a2 layer adjacent to each other, it is important that the relation between a film thickness ratio Xb in a substrate-side region (a base material side of the die) of the alternating lamination section and a film thickness ratio Xt on an outermost layer side is Xt>Xb (hereinafter, a film thickness of the a1 layer is also described as $t_{a1}$, a film thickness of the a2 layer is also described as $t_{a2}$, and the film thickness ratio of the a2 layer with respect to the a1 layer is also described as $t_{a2}/t_{a1}$. Moreover, $t_{a2}/t_{a1}$ is the film thickness ratio X). FIG. 6 shows an example of a temperature change of the die in hot stamping processing. When the hot stamping is performed at a fixed interval, as shown in FIG. 6, the temperature of the die shows a behaviour in which a temperature rise resulted from the contact with the heated material to be processed and a temperature decrease resulted from water cooling from the inside and/or the outside are repeated, and as the processing progresses, the overall temperature is increased and the overall temperature rise is stopped at a certain fixed processing stage. Moreover, in the specification, the stage in which the overall temperature rise is progressing (region A in FIG. 6) is defined as an initial stage, and the stage after the overall temperature rise is stopped (region B in FIG. 6) is defined as an intermediate stage. Considering the temperature environment, in the film of the die for use in hot stamping, a configuration in which good adhesion resistance is exhibited in the initial stage of the processing and excellent abrasion resistance is exhibited in the intermediate stage of the processing, in which the abrasion is likely to progress in the high temperature environment, is suitable for extending the life. In the embodiment, by setting the relation between the film thickness ratio Xb ($t_{a2}/t_{a1}$) of the alternating lamination section of the hard film on the substrate side and the film thickness ratio Xt ($t_{a2}/t_{a1}$) of the alternating lamination section of the hard film on the outermost surface side as Xt>Xb, a layer configuration in which the a2 layer, which is the vanadium-containing film having excellent adhesion resistance and galling resistance, becomes the main body can be set in the initial stage of the processing, and a layer configuration in which the proportion of the a1 layer, which is the CrN-based film having excellent abrasion resistance, becomes larger than the initial stage can be set after the intermediate stage of the processing in which the surface layer side is abraded, and thus the life of the die for use in hot stamping can be greatly improved. Moreover, the "substrate-side region" of the alternating lamination section in the embodiment indicates a thickness region of ¼ of a total thickness of the alternating lamination section in the thickness direction from an interface between the substrate and the alternating lamination section or an interface between another film formed directly below the alternating lamination section (on the substrate side) and the alternating lamination section. In addition, the "outermost surface side region" of the alternating lamination section in the embodiment indicates a thickness region of ¼ of the total thickness of the alternating lamination section in the thickness direction from the outermost surface (the side opposite to the substrate) of the alternating lamination section or an interface between another film formed directly above the alternating lamination section (on the surface side) and the alternating lamination section.

In the embodiment, in order to increase the film thickness ratio X ($t_{a2}/t_{a1}$) on the outermost surface side with respect to the substrate side of the hard film, the thickness of the a2 layer may be increased toward the surface layer, or the thickness of the a1 layer may be reduced toward the surface layer side. In addition, the thickness fluctuation can also exhibit the effect even if it is inclined or stepwise, and the thickness fluctuation may be appropriately selected according to the purpose. For example, when the thickness is changed in a stepwise manner, the film can be easily produced even by a general PVD device, and when the thickness is changed in an inclined manner, the stress distribution inside the film is stabilized, and peeling between layers is less likely to occur. Here, "change in an inclined manner" indicates that at least one of the a1 layer and the a2 layer fluctuates for every one layer. "Change in a stepwise manner" indicates that two or more layers having the same thickness are included in the a1 layer and the a2 layer. Moreover, the lower limit of $t_{a2}/t_{a1}$ is not particularly limited, and can be appropriately set according to the purpose. For example, a film in which $t_{a2}/t_{a1}$ is sufficiently small (a film in which the effect of the adhesion resistance caused by the vanadium is reduced) is formed on the substrate side, the component of the material to be processed is intentionally adhered after the intermediate stage of the hot stamping, and thereby the wear (the life) of the film can be detected, and the wear can be suppressed from reaching the substrate. Thereby, the trouble of repairing the die can be saved. The lower limit of $t_{a2}/t_{a1}$ can be set to, for example, 0.1.

Here, when the film thickness ratio $t_{a2}/t_{a1}$ is increased in a stepwise manner, for example, it suffices to have an alternating lamination section (section A) in which $t_{a2}/t_{a1}$ is less than 1.2, preferably 1.0 or less on the substrate side, and an alternating lamination section (section B) which is formed on an upper layer of the section A being the outermost layer side and in which $t_{a2}/t_{a1}$ is 1.2 or more, preferably 1.4 or more. At this time, the thickness of the section A is preferably 60% or more of the total film thickness. The reason is that the thicker the section A having excellent abrasion resistance, the longer the life during the high temperature processing can be extended. On the other hand, if the film thickness of the section A is too thick with respect to the total film thickness, the adhesion resistance effect tends to be reduced, and thus the upper limit of the section A can be set to 90% of the total film thickness. In addition, the thickness of the section B is preferably set to less than 40% of the total film thickness. The reason is that the section B is most effective in the initial stage of the processing, and thus if the section B is too thick with respect to the total film thickness, the purpose of the present invention for ensuring the abrasion resistance in the intermediate stage of the processing which is a high temperature environment may not be achieved. In addition, the thickness of the section B is preferably 10% or more of the total film thickness. In the above, an example having two alternating lamination sections with different $t_{a2}/t_{a1}$ is described, but as long as the relation between the film thickness ratio Xb of the alternating lamination section on the substrate side and the film thickness ratio Xt of the alternating lamination section on the outermost layer side is Xt>Xb, the present invention is not limited to the above-described embodiment, and appropriate changes such as an arrangement of three or more regions having different film thickness ratios and the like can be made. When three or more regions having different film thickness ratios exist in the alternating lamination section, it is preferable to configure in a manner that the film thickness ratio $t_{a2}/t_{a1}$ tends to be increased in a stepwise manner from the substrate side to the outermost layer side. As an example in which three or more regions having different film thickness ratios exist, a coating structure can be applied, which includes an alternating lamination section (section A) in which $t_{a2}/t_{a1}$ is less than 0.8 on the substrate side, a section B which is formed on a surface layer side of the section A and in which $t_{a2}/t_{a1}$ is 0.8 or more and less than 1.2, and a section C which is formed on a surface layer side of the section B and in which $t_{a2}/t_{a1}$ is 1.2 or more.

In addition, in order to further enhance the abrasion resistance after the intermediate stage of the processing, it is preferable that a CrN-based film different from the above-described alternating lamination section is formed directly below the alternating lamination section. The reason is that, as described above, there is a concern that the CrN-based film alone cannot exhibit a sufficient adhesion resistance effect, but by the intentional adhesion on the substrate side, the wear of the film can be detected, and the wear can be suppressed from reaching the substrate. Moreover, regarding the CrN-based film, a nitride layer having the same component as the above-described a1 layer is preferable because it is rational in industrial production, but a layer having a component different from the a1 layer may also be used. According to desired characteristics, the CrN-based film can be formed into a single layer structure or a multi-layer structure (including an alternating lamination structure) having two or more layers. Particularly, when the CrN-based film is formed into an alternating lamination structure, cracks pass through a lamination interface when the film is broken. Thus, the crack progress path becomes complicated and the rapid progress is suppressed. As a result, fracture resistance of the film can be improved, and thus it is preferable. Here, when an alternating lamination structure of b1 layers and b2 layers is selected for the CrN-based film directly below the alternating lamination section, the b1 layer and the b2 layer can be selected from CrN, CrTiN, CrVN, CrSiN, CrBN, CrSiBN, CrTiSiN, CrVSiN, AlCrN, AlTiCrN, AlVCrN, AlCrSiN, AlTiCrSiN, and AlVCrSiN. Preferably, the b1 layer is selected from AlCrSiN and CrSiBN, and the b2 layer is selected from CrSiBN and CrN. More preferably, AlCrSiN is selected for the b1 layer, and CrN is selected for the b2 layer.

The total thickness of the CrN-based film formed directly below the alternating lamination section is preferably 0.5 μm or more, and is preferably 50 μm or less. The more preferable thickness of the CrN-based film is 40 μm or less, and the further preferable thickness of the CrN-based film can be set to 30 μm or less, 20 μm or less, or 10 μm or less. In addition, when the alternating lamination structure of the b1 layers and the b2 layers is selected, the film thicknesses of the b1 layer and the b2 layer are preferably 0.002 μm to 0.1 μm respectively. Besides, the CrN-based film formed directly below the alternating lamination section is preferably formed 1.2 times or more thicker than the a1 layer.

Furthermore, in order to further improve adaptability between the die and the material to be processed in the initial stage of the processing and suppress sudden galling, it is preferable that a VN-based film (a single layer) different from the alternating lamination section is formed directly above the alternating lamination section. Similarly, regarding the VN-based film, a nitride layer having the same component as the a2 layer is preferable because it is rational in industrial production. However, the VN-based film is not limited thereto, and a layer having a component different from the a2 layer may also be used.

The thickness of the VN-based film directly above the alternating lamination section is preferably 0.1 μm or more, and more preferably 0.2 μm or more. The upper limit of the thickness is not particularly limited, but when the film thickness becomes too thick, it takes time to form a film and the productivity deteriorates, and thus the thickness is preferably 8 μm or less. In addition, because the abrasion resistance of the entire film may be lowered depending on the use environment, the film thickness is more preferably 5 μm or less, and further preferably 3 μm or less. Moreover, the VN-based film directly above the alternating lamination section is preferably formed 1.2 times or more thicker than the a2 layer.

In the embodiment, the film thickness of the a1 layer is preferably 0.002 μm to 0.1 μm. By keeping the film thickness within this range, it is effective to achieve both the abrasion resistance and the adhesion resistance by the alternating lamination with the a2 layer. If the film thickness of the a1 layer is too thin, the effect of improving the abrasion resistance becomes difficult to exhibit. On the other hand, when the film thickness of the a1 layer is too thick, the a1 layer is exposed to most of the surface, and thus the material to be processed tends to be easily adhered.

In the embodiment, the film thickness of the a2 layer is preferably 0.002 μm to 0.08 μm. By keeping the film thickness within this range, it is effective to achieve both the abrasion resistance and the adhesion resistance by the alternating lamination with the a1 layer. If the film thickness of the a2 layer is too thin, the effect of improving the adhesion resistance becomes difficult to exhibit. On the other hand, when the film thickness of the a2 layer is too thick, the a1 layer is deficient in most of the surface, and thus the film tends to be easily abraded.

The total thickness of the alternating lamination section of the embodiment is preferably 5 μm to 80 μm, and more preferably 10 μm to 50 μm. The reason is that if the alternating lamination section is too thin, the film cannot withstand the harsh abrasion environment of the hot stamping and tends to wear at an early stage, and if the alternating lamination section is too thick, the dimension tolerance of the die is exceeded, the clearance on the molding surface is insufficient, excessive drawing processing may be performed and the molding load may be increased.

The material (the base material and the substrate) used in the die of the present invention is not particularly specified, and tool steel such as cold die steel, hot die steel, and high-speed steel, super hard alloys, or the like can be appropriately used. A surface hardening treatment in which diffusion is utilized, such as a nitriding treatment, a carburizing treatment or the like, may be previously applied to the die. In addition, a film different from the hard film may be formed on the die surface within a range not interfering with the above-described effect of the hard film of the present invention.

Regarding the manufacturing method of the hard film according to the present invention, an existing film forming method can be used, but it is preferable to select a physical vapor deposition method (PVD) such as an are ion plating method, a sputtering method, or the like in which the coating treatment can be performed at a temperature lower than the tempering temperature of the die and the die dimension fluctuation can be suppressed. In addition, in order to obtain a hard film which is smoother and has an excellent sliding characteristic, the surface of the hard film may be polished during or after coating.

EXAMPLE

Example 1

First, the initial stage of the hot stamping processing was simulated and an adhesion resistance evaluation was performed.

For the substrate, a high-speed steel SKH51 (21 mm×17 mm×2 mm) that has been mirror-polished, degreased and cleaned was prepared, and the prepared substrate was set in an are ion plating device having a structure in which the substrate rotates around a center surrounded by a plurality of targets. An $Al_{60}Cr_{37}Si_3$ target was used as the target for the a1 layer, and a vanadium target was used as the target for the a2 layer. After that, as an initial step, the substrate was heated and degassed at 450° C. in the device, then Ar gas was introduced, and a plasma cleaning treatment (Ar ion etching) of the substrate surface was performed.

Figure 2:
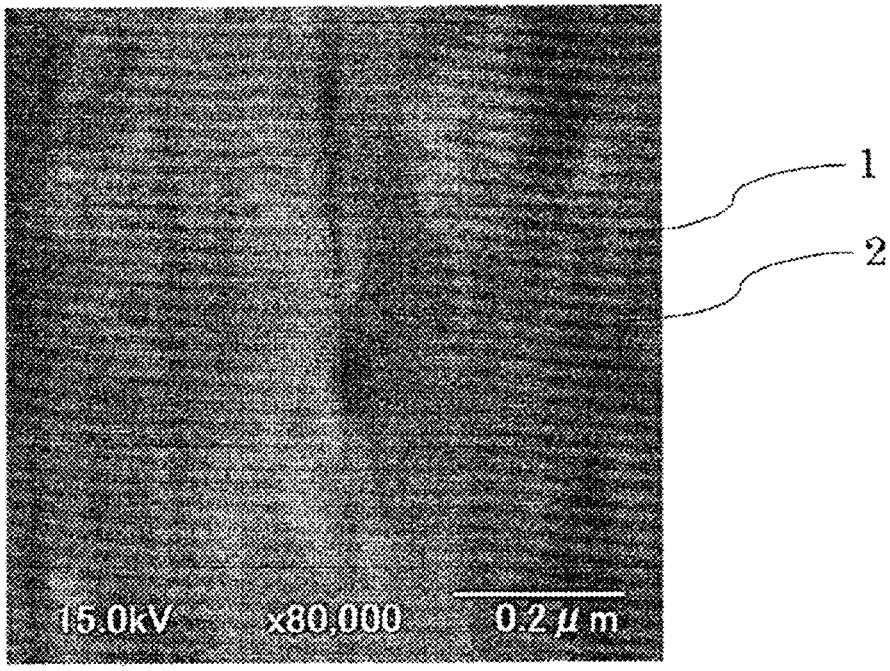
FIG. 2 is a cross-sectional photograph of Sample No. 2 showing an example of an alternating lamination section on an outermost layer side of the present invention.

Subsequently, nitrogen gas was introduced and the coating was performed on the substrate after the plasma cleaning treatment to produce Sample No. 1 and Sample No. 2. Both Sample No. 1 and Sample No. 2 formed a film (the alternating lamination section) consisting of an alternating lamination structure of AlCrSiN (at %) and VN (hereinafter, also described as AlCrSiN/VN), and Sample No. 1 was adjusted in a manner that $t_{a2}/t_{a1}$ was smaller than that of Sample No. 2. A cross-sectional photograph of the alternating lamination section of Sample No. 1 is shown in FIG. 1, and a cross-sectional photograph of the alternating lamination section of Sample No. 2 is shown in FIG. 2. In FIG. 1 and FIG. 2, Reference numeral 1 indicates the AlCrSiN film, and Reference numeral 2 indicates the VN film. After the film formation, the individual film thicknesses of AlCrSiN/VN of Sample No. 1 were measured, and as a result, it was confirmed that AlCrSiN is 19 nm and VN is 15 nm ($t_{a2}/t_{a1}$=0.79). Similarly, regarding the individual film thicknesses of the alternating lamination section of Sample No. 2, AlCrSiN is 10 nm and VN is 15 nm ($t_{a2}/t_{a1}$=1.5). The total film thicknesses of the alternating lamination section of Sample No. 1 and Sample No. 2 were 10.5 μm and 17.6 μm respectively.

Figure 3:
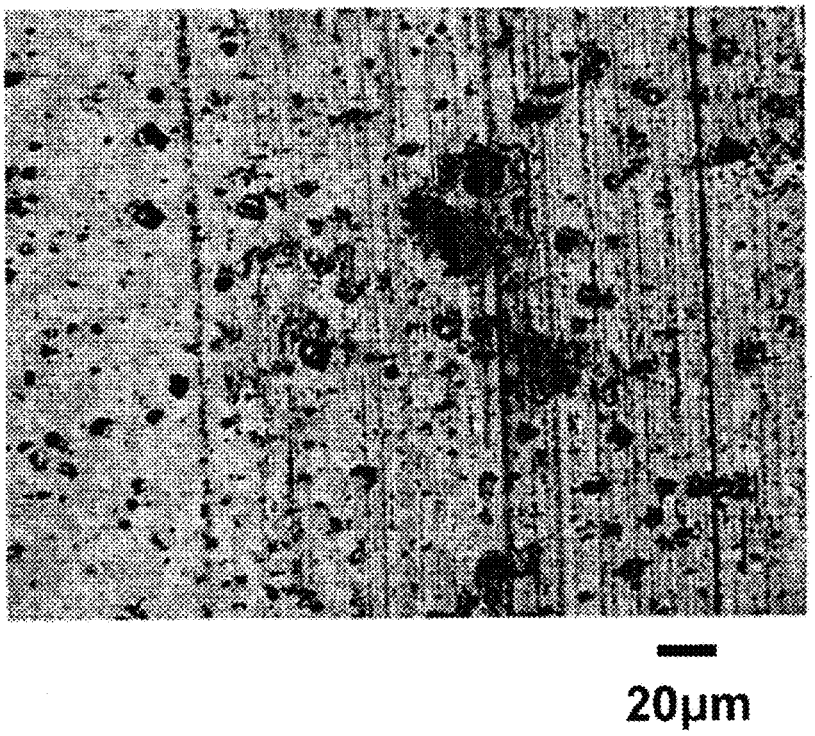
FIG. 3 is a sample surface photograph of Sample No. 2 after an adhesion evaluation test at 25° C. for describing the effect of the present invention.
Figure 4:
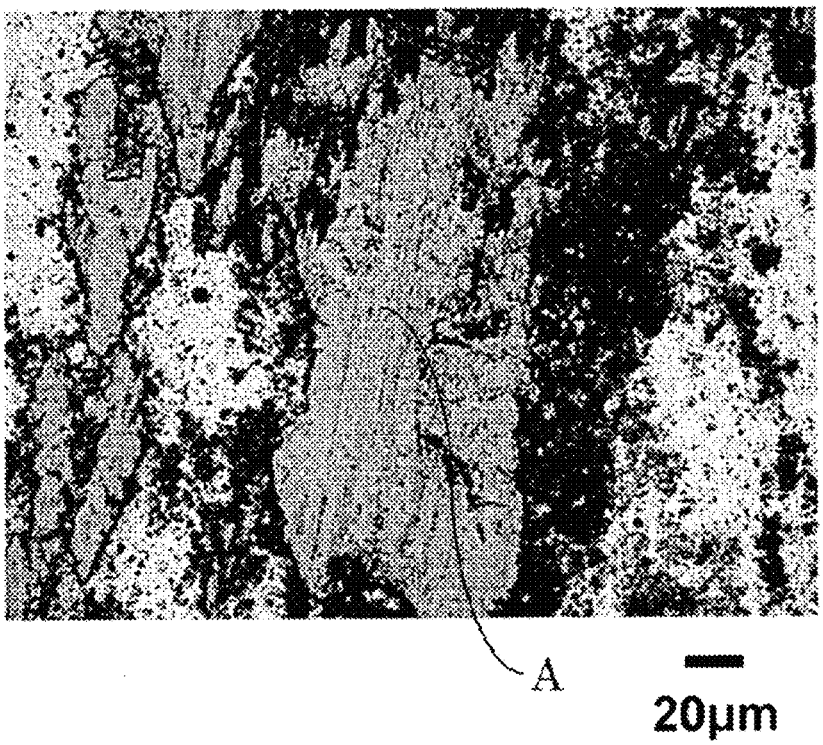
FIG. 4 is a sample surface photograph of Sample No. 1 after an adhesion evaluation test at 25° C. for describing the effect of the present invention.
Figure 5:
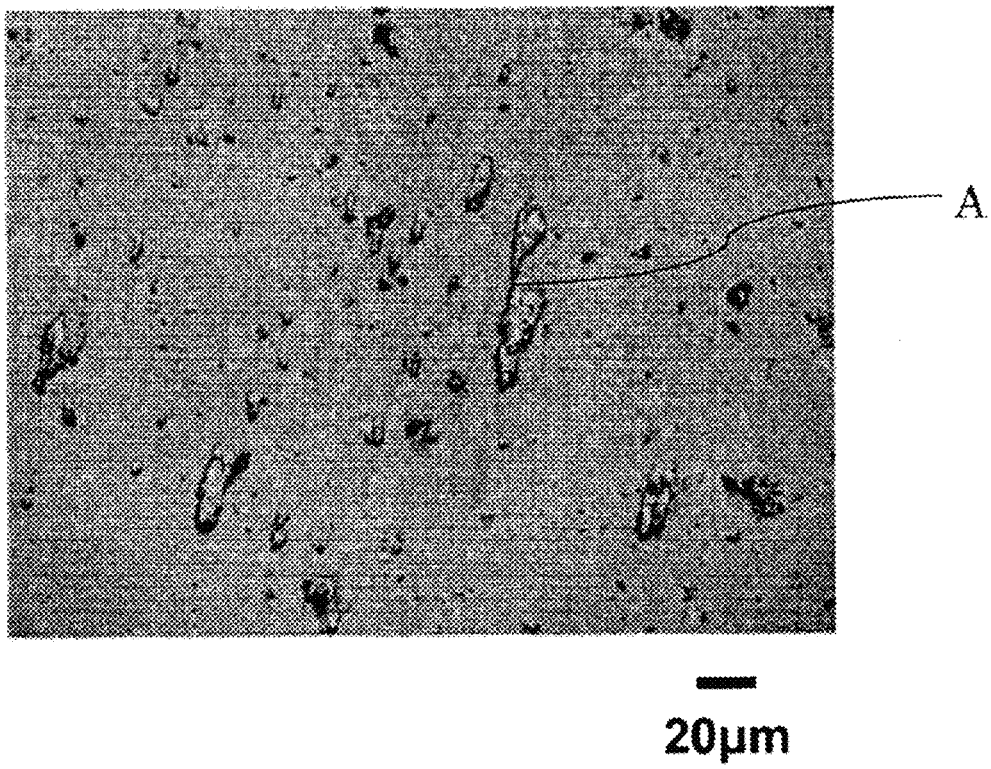
FIG. 5 is a sample surface photograph of Sample No. 1 after an adhesion evaluation test at 400° C. for describing the effect of the present invention.

The produced sample was subjected to the adhesion resistance test. A ball-on-disk testing machine (Tribometer manufactured by CSM Instruments) was used for the test. The test environment was set in two types, including an environment in the atmosphere at 25° C. assuming the initial stage of the hot stamping, and an environment, as a reference, in the atmosphere at 400° C. assuming the intermediate stage. A bearing ball made of SUJ2 (a mirror-polished ball having a diameter of 6 mm, the hardness was 60 HRC) was pressed against the alternating lamination section by a load of 2 N, and the sample was continuously slid for 100 m in a fixed direction at a speed of 10 cm/sec without lubrication. After the test, the surface of the sliding section of the sample was observed. As a result, in the 25° C. environment, regarding Sample No. 1, a lot of adhesion of the mating material (Reference numeral A) was found as shown in FIG. 4, and regarding Sample No. 2, the adhesion of the mating material was not confirmed as shown in FIG. 3. It is considered that this is because the effect of the adhesion resistance caused by the vanadium was limited in the alternating lamination section ($t_{a2}/t_{a1}$=0.79) having relatively less VN in the environment simulating the initial stage of the hot stamping. On the other hand, regarding the adhesion (Reference numeral A) in the 400° C. environment, it can be confirmed that the adhesion amount of Sample No. 1 was greatly reduced as shown in FIG. 5. It is considered that this is because oxidation of VN was promoted in the high temperature environment simulating the intermediate term of the hot stamping, and thus even the alternating lamination section ($t_{a2}/t_{a1}$=0.79) having relatively less VN was sufficient to exhibit the effect of the adhesion resistance caused by the vanadium.

Example 2

Subsequently, the intermediate stage of the hot stamping processing was simulated and the abrasion resistance evaluation was performed. Regarding the sample to be evaluated, in addition to Sample No. 1 and Sample No. 2 of Example 1, Sample No. 3 in which the film individual thicknesses of AlCrSiN/VN were adjusted to AlCrSiN: 19 nm, VN: 10 nm ($t_{a2}/t_{a1}$=0.52), the total film thickness of the alternating lamination section was set to 19 μm, and other manufacturing methods were the same as Sample No. 1, and Sample No. 4 served as a comparative example which did not contain V and was alternating lamination of AlCrSiN and CrN (the alternating lamination in which AlCrSiN is 23 nm and CrN is 26 nm, and the total thickness was 4.1 μm) were further prepared. A ball-on-disk testing machine (Tribometer manufactured by CSM Instruments) was used for the test. The test environment was set in the atmosphere at 400° C. assuming the intermediate processing of the hot stamping. A pin made of matrix high-speed steel (a mirror-polished hemisphere having a front-end diameter of 6 mm, the hardness was 64 HRC) was pressed against the film by a load of 10 N, and the sample was continuously slid with a sliding diameter of 8.5 mm in a fixed direction at a speed of 20 cm/sec without lubrication. The sliding distance was 1000 m. After the test, a volume of a groove formed on the sliding circumference of the sliding section was calculated as an abrasion volume, and was divided by the test load of 10 N and the sliding length of 1000 m, which are test conditions, and the abrasion volume per unit sliding length and per unit load was evaluated as the specific abrasion amount. The volume of the groove was calculated by the method below. Groove depths of each sliding section in Samples No. 1 to 4 were measured on concentric circles having an interval of 0.2 mm from the inner diameter side to the outer diameter side of the above-described sliding circle by a non-contact surface shape measuring machine (Newview 7300 manufactured by Zygo Corporation), an average value of the groove depths of each concentric circle and the measurement interval were summed, and the average groove cross-sectional area was calculated. The sliding circumferential length was integrated to the groove cross-sectional area, and the groove volume was obtained. The result of the specific abrasion amount of Samples No. 1 to 4 is shown in FIG. 7 (a bar graph of the specific abrasion amount).

Figure 7:
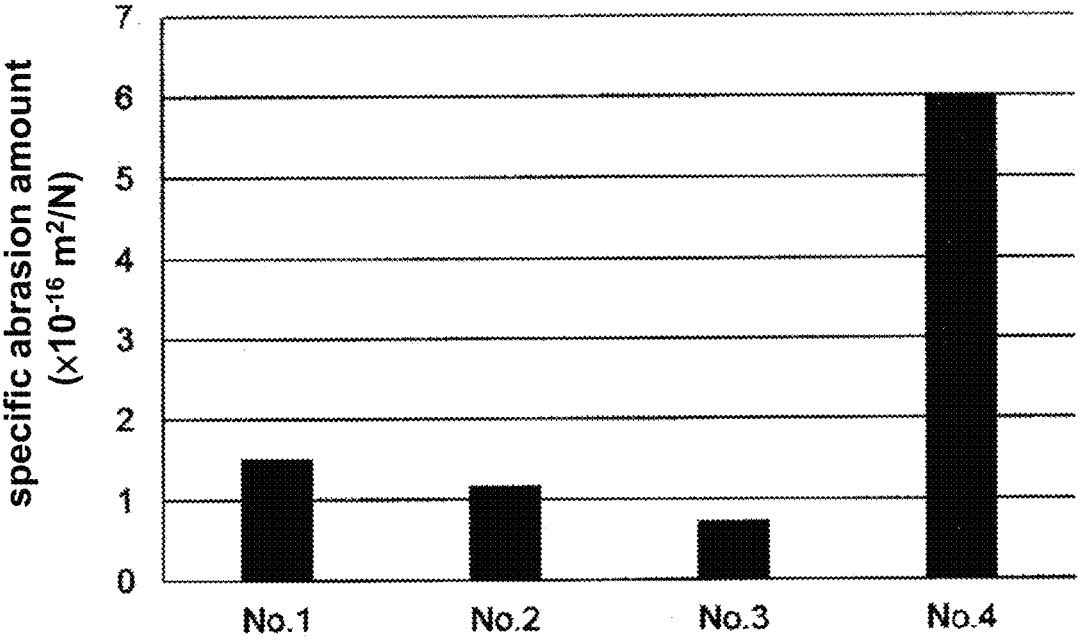
FIG. 7 is a graph showing the result of the abrasion resistance evaluation of examples of the present invention and a comparative example.

According to the result in FIG. 7, it was confirmed that the specific abrasion amount became smaller in the order of Sample No. 4, Sample No. 1, Sample No. 2, and Sample No. 3, and particularly, the specific abrasion amount of the No. 4 film was much larger than that of Samples No. 1 to 3. The reason is that in the case of the No. 4 film, the effect of the adhesion resistance caused by the vanadium cannot be obtained in the first place, and thus the adhesion abrasion progresses even in the high temperature environment where the oxidation of VN is promoted. In addition, in Samples No. 1 to 3, it can be confirmed that the smaller the value of $t_{a2}/t_{a1}$, the more excellent the abrasion resistance in the intermediate stage of the hot stamping processing.

According to the above results, it can be confirmed that the film configuration of the example of the present invention, in which the alternating lamination film in which $t_{a2}/t_{a1}$=1.5 is formed on the upper side of the alternating lamination film in which $t_{a2}/t_{a1}$=0.79 or 0.52, can improve the abrasion resistance and the adhesion resistance of the film in the entire processing stage of the hot stamping processing, and is effective for improving the life of the die.

What is claimed is:

1. A coated die for use in hot stamping, which has a hard film on a work surface, wherein the hard film has an alternating lamination section formed by alternating lamination of a1 layers consisting of nitride in which a metal part including semimetals has 30% or more of chromium in atomic ratio, and a2 layers consisting of nitride in which a metal part including semimetals has 50% or more of vanadium in atomic ratio, and when $ta_1$ and $ta_2$ are defined as thicknesses of the a1 layer and the a2 layer respectively, a film thickness ratio Xb is defined as a film thickness ratio $t_{a2}/t_{a1}$ of a1 layers and a2 layers adjacent to each other in a substrate-side region of the alternating lamination section and a film thickness ratio Xt is defined as a film thickness ratio $t_{a2}/t_{a1}$ of a1 layers and a2 layers adjacent to each other in an outermost surface side region of the alternating lamination section, it holds that Xt>Xb, the Xt is 1.2 or more, and the Xb is 1.0 or less.

2. The coated die for use in hot stamping according to claim 1, wherein a total film thickness of the alternating lamination section is 6 μm or more.

* * * * *